US006135763A

United States Patent [19]

Man

[11] Patent Number: 6,135,763

[45] Date of Patent: Oct. 24, 2000

[54] UTILITY LIGHTER WITH AN AUTOMATICALLY LOCKING CHILD-RESISTANT MECHANISM

[76] Inventor: Aman Chung Kai Man, Unit 1, 11/F, Wah Lai Ind. Centre 10-14 Kwei Tei Street, Fo Tan, Sahtin, N.T., The Hong Kong Special Administrative Region of the People's Republic of China

[21] Appl. No.: 09/468,549

[22] Filed: Dec. 20, 1999

[51] Int. Cl.[7] ..... F23D 11/36

[52] U.S. Cl. ..... 431/153; 431/255; 431/344

[58] Field of Search ..... 431/153, 255, 431/344, 345, 266, 277, 276, 254, 310; 126/25 B, 404, 407, 414

[56] References Cited

U.S. PATENT DOCUMENTS

| | | | |
|---|---|---|---|
| 4,904,180 | 2/1990 | Nitta | 431/153 |
| 5,145,358 | 9/1992 | Shike et al. | 431/153 |
| 5,324,193 | 6/1994 | Pan | 431/277 |
| 5,462,432 | 10/1995 | Kim | 431/255 |
| 5,697,775 | 12/1997 | Saito et al. | 431/153 |
| 5,829,963 | 11/1998 | Ichikawa | 431/255 |
| 5,839,892 | 11/1998 | Hwang | 431/153 |
| 5,997,282 | 12/1999 | Man | 431/255 |

*Primary Examiner*—James C. Yeung
*Attorney, Agent, or Firm*—Trojan Law Offices

[57] ABSTRACT

The invention includes a child-resistant mechanism for a utility lighter. The child-resistant mechanism includes an operation member for activating the piezoelectric unit. The operation member has an inoperable position and an operable position. Attached to the back side of the operation member is a horizontal lever for activating the fuel-release lever as the operation member is moved into the operable position then depressed in one motion by the finger of a user. A spring, attached to the horizontal lever, urges the operation member into the inoperable position. Further the horizontal lever cannot activate the fuel-release lever as the operation member is depressed while in the inoperable position because the horizontal lever and the fuel-release lever are not aligned.

12 Claims, 1 Drawing Sheet

UTILITY LIGHTER WITH AN AUTOMATICALLY LOCKING CHILD-RESISTANT MECHANISM

BACKGROUND OF THE INVENTION

1. Field of the Invention

This invention relates generally to utility lighters, and more specifically to child-resistant utility lighters.

2. Description of Related Art

Utility lighters are very useful and have become quite prevalent in modern times. Utility lighters of the type described herein generally contain a handle and an elongated lighting rod. The shape and operation of utility lighters allow for several advantages over normal means of producing a flame. Most significantly, due to the elongated nature of the lighting rod, utility lighters enable the operator to stand a safe distance away from the object to be ignited before actuating the lighter, thus avoiding a large number of potential accidents. In addition, utility lighters allow a flame to be produced in hard-to-reach or narrow places, where the human hand holding a match would not normally fit. Still, in the hands of children, or others who do not know how to safely and properly operate the lighter, such lighters are as dangerous as any other spark and/or flame-producing device. Therefore, a need has been realized to equip utility lighters with safety features that minimize accidental or improper use by inexperienced persons, especially young children.

Many inventions have been created to address this safety-related concern. Generally, these inventions have sought to introduce safety mechanisms that disable automatic operation of either the spark-generation and/or the fuel-release function of the lighter. For example, some utility lighters provide for a blocking mechanism, where the actuating trigger is blocked from moving the required distance for a spark to be generated. In these lighters, the locking mechanism is normally de-activated by sliding an "on/off" switch to the "on" position, or by other means, so as to remove the impediment from the actuating trigger's operating path.

Although utility lighters of the type described above provide some level of safety, there is much room for improvement.

Specifically, in these lighters, once the locking means (e.g., the on/off switch) is disabled, the lighter remains in the unlocked state until the locking mechanism is activated again. Therefore, if the operator disables the locking mechanism in order to use the lighter, and then forgets to re-lock the lighter, the safety feature of the lighter is rendered useless, until the locking mechanism is again activated.

From the preceding descriptions, it is apparent that the devices currently being used have significant disadvantages. Thus important aspects of the technology used in the field of invention remain amenable to useful refinement.

SUMMARY OF THE INVENTION

The present invention introduces such refinement. This child-resistant mechanism creates a utility lighter that is child-resistant yet does not sacrifice ease of use for the proper user. The user need only engage in one extra maneuver to create a flame. Namely, the operation member must be first moved in the upward direction then depressed. Both of these steps are done in one continuous step, therefore, the only additional movement required is lifting prior to depressing. Although this is extremely easy for an adult user, a majority of children will not be able to determine that in order to create a flame the operation member must first be moved in the upward direction.

Another feature that further limits the child's ability to generate a flame is that the operation member can be depressed and create a spark when it is not first moved in the upward direction.

This makes the child think it is properly actuating the lighter yet it is not working to generate a flame. Thus leading the child to believed the lighter is broken.

All of the foregoing operational principles and advantages of the present invention will be more fully appreciated upon consideration of the following detailed description, with reference to the appended drawings.

DESCRIPTION OF THE PREFERRED EMBODIMENTS

While the invention will be described in connection with preferred embodiments, it will be understood that it is not intended to limit the invention to those embodiments. On the contrary, it is intended to cover all alternatives, modifications, and equivalents as may be included within the spirit and scope of the invention as defined by the appended claims.

A general description of the piezoelectric utility lighter (100) will be provided before presenting a detailed description of the improvement in the safety feature that constitutes the invention.

Figure 1:
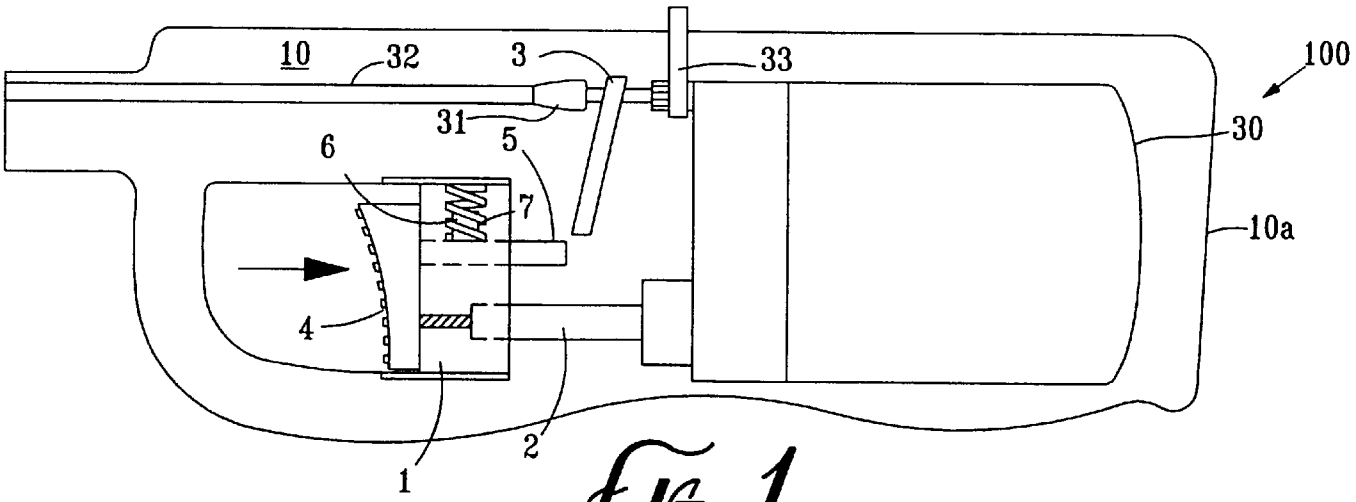
FIG. 1 is a cross-sectional view of the child-resistant mechanism in the nonoperable position.

The lighter housing (10) is comprised of two shells, cut along the longitudinal axis of the lighter (100). FIG. 1 shows one of these shells. The lighter housing (10) has a back end **(10*a*) and a forward end (not shown), where the forward end is equipped with engagement means (not shown) to engage a lighting rod (not shown). The lighting rod, which typically has a cylindrical cross section, has a free end which constitutes the tip of the lighter (100)** and an engagement end which connects to the forward end of the lighter housing. Where the forward end of the lighter housing and the engagement end of the lighting rod overlap, there is provided a support ring (not shown) which slides over and maintains the lighter housing-lighting rod combination.

The lighter (100) is equipped with a fuel tank (30) near the back end **(10*a*) of the lighter housing (10). A fuel-release valve (31) is attached to the fuel tank. This valve is spring loaded so that it is normally urged to the closed position. The valve is also provided with a gas tube (32) which extends through the lighting rod and to a discharge nozzle (not shown) at the free end of the lighting rod. The valve is opened via the operation of a fuel-release lever (3). Finally, a flame-adjusting knob (33) is provided on the valve (31)** which can be turned to adjust the amount of fuel released and, thus, the height of the resultant flame.

The next element of the lighter (100) is a piezoelectric unit (2). This unit is located above fuel tank. Operation of the piezoelectric unit (2) creates an electric discharge that is carried to the free end of the lighting rod via a wire (not shown).

The preferred embodiment of the child-resistant mechanism includes an operation member (4) (FIG. 1), a trigger (1), a horizontal lever (5), and a spring (7). The operation member is slidably mounted into the lighter housing. It is slidably mounted such that it has an initial position, an operable position, an initial- depressed position, and an operable-depressed position. The operation member is curved for receiving the finger of a user, and to aid the user in moving the operation member upward into the operable position.

The horizontal member (5) is attached to and extends from the back side of the operation member (4). The horizontal member activates the fuel-release lever when the operation member is in the operable-depressed position. When the operation member is in the initial position the horizontal lever is not aligned with the fuel-release lever (3), therefore, when the operation member is in the initial-depressed position the horizontal lever passes beneath the fuel-release lever. As such no flame can be generated.

Figure 2:
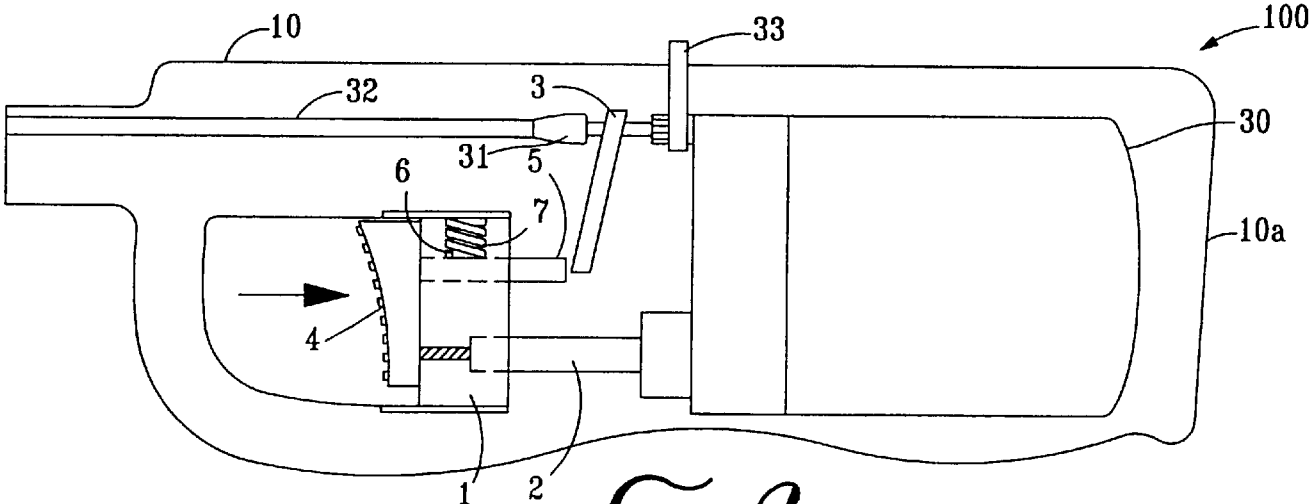
FIG. 2 is a like view of the child-resistant mechanism in the operable position.

In order to operate the lighter so that a flame can be produced, the horizontal lever (5) (FIG. 2) must be moved up against the force of the spring (7), so that, as the horizontal lever (5) moves back, it can make contact with and activate the fuel-release lever (3). This is done by pulling up on, and then depressing, the operation member (4) in one continuous motion. Now, as the operation member (4) moves back into the operable-depressed position, the horizontal lever (5) causes the fuel-release lever (3) to turn and release fuel, so that a flame can be generated once the operation member and trigger (1) have been depressed far enough in order for the piezoelectric unit (2) to be activated. When the flame is no longer needed, the operation member (4) is released, and the spring (7) urges the operation member (4) back down to its initial position.

I claim:

1. A child-resistant mechanism of a utility lighter, the utility lighter having a fuel tank, a piezoelectric unit for generating a spark, a fuel-release valve, and a fuel-release lever for activating the fuel-release valve, said child-resistant mechanism comprising:

an operation member for activating the piezoelectric unit, the operation member having a surface for receiving a finger of a user, an inoperable position, and an operable position;

a horizontal lever, attached to the back side of the operation member, for activating the fuel-release lever as the operation member is moved into the operable position then depressed in one motion by the finger of a user;

a spring, attached to the horizontal lever, for urging the operation member into the inoperable position;

wherein the horizontal lever cannot activate the fuel-release lever as the operation member is depressed while in the inoperable position.

2. The child-resistant mechanism of claim 1, further comprising a trigger, located between the operation member and the piezoelectric unit, that works in conjunction with the operation member to activate the piezoelectric unit.

3. The child-resistant mechanism of claim 1, further comprising a pin, located within the spring, for supporting the spring in a compressed position as the operation member is depressed while in the operable position.

4. The child-resistant mechanism of claim 1, wherein the surface of the operation member is curved.

5. A child-resistant mechanism of a utility lighter, the utility lighter having a fuel tank, a piezoelectric unit for generating a spark, a fuel-release valve, and a fuel-release lever for activating the fuel-release valve, said child-resistant mechanism comprising:

an operation member being slidably mounted in the lighter housing such that the operation member has an initial position, an upward position, an initial-depressed position, and an upward-depressed position, the operation member is constantly in contact with the piezoelectric unit such that a spark can always be created by sliding the operation member in the depressed position;

a horizontal member, attached to the operation member, for activating the fuel-release lever when the operation member is in the upward-depressed position; and a spring, located on the horizontal member, for urging the operation member into the initial position;

wherein the horizontal member can only activate the fuel-release lever when the operation member is in the upward-depressed position.

6. The child-resistant mechanism of claim 5, further comprising a trigger, located between the operation member and the piezoelectric unit, that works in conjunction with the operation member to activate the piezoelectric unit.

7. The child-resistant mechanism of claim 5, further comprising a pin, located within the spring, for supporting the spring in a compressed position as the operation member is depressed while in the operable position.

8. The child-resistant mechanism of claim 5, wherein the surface of the operation member is curved.

9. A child-resistant mechanism of a utility lighter, the utility lighter having a fuel tank, a piezoelectric unit for generating a spark, a fuel-release valve, and a fuel-release lever for activating the fuel-release valve, said child-resistant mechanism comprising:

an operation member being slidably mounted in the lighter housing such that the operation member has an initial position, an upward position, an initial-depressed position, and an upward-depressed position, the operation member is constantly in contact with the piezoelectric unit such that a spark can always be created by sliding the operation member in the depressed position;

a horizontal member, attached to the operation member, for activating the fuel-release lever when the operation member is in the upward-depressed position; and a spring, located on the horizontal member, for urging the operation member into the initial position;

wherein the fuel-release lever is a certain length such that the horizontal lever is aligned with the fuel-release lever only when the operation member and the horizontal lever are in the upward position.

10. The child-resistant mechanism of claim 9, further comprising a trigger, located between the operation member and the piezoelectric unit, that works in conjunction with the operation member to activate the piezoelectric unit.

11. The child-resistant mechanism of claim 9, further comprising a pin, located within the spring, for supporting the spring in a compressed position as the operation member is depressed while in the operable position.

12. The child-resistant mechanism of claim 9, wherein the surface of the operation member is curved.

* * * * *